United States Patent [19]

Beatty

[11] Patent Number: 4,910,927

[45] Date of Patent: Mar. 27, 1990

[54] KNEE SUPPORTING CRUTCH ATTACHMENT

[76] Inventor: Robert Beatty, 133 Beatty St., Apollo, Pa. 15613

[21] Appl. No.: 274,839

[22] Filed: Nov. 23, 1988

[51] Int. Cl.[4] ..... A45B 3/00

[52] U.S. Cl. ..... 135/66; 135/68; 182/187; 182/120; 248/155.3

[58] Field of Search ..... 135/68, 66; 248/155–155.5; 182/187, 188, 120

[56] References Cited

U.S. PATENT DOCUMENTS

| | | | |
|---|---|---|---|
| 558,187 | 4/1896 | Lewis | 248/155.2 |
| 731,437 | 6/1903 | Czermak | 135/66 |
| 751,942 | 2/1904 | Renno | 135/68 |
| 807,039 | 12/1905 | Martin | 248/155.5 |
| 1,463,675 | 7/1923 | Coleman | 135/68 |
| 1,972,668 | 9/1934 | Sheldon | 248/155.2 |
| 2,495,889 | 1/1950 | Connaghan | 135/68 |
| 2,678,054 | 5/1954 | Bostelman | 135/68 |
| 4,237,915 | 12/1980 | Zabielski | 135/68 |

FOREIGN PATENT DOCUMENTS

| | | | |
|---|---|---|---|
| 483059 | 5/1917 | France | 135/66 |

*Primary Examiner*—Henry E. Raduazo
*Attorney, Agent, or Firm*—Richard C. Litman

[57] ABSTRACT

An attachment for existing crutches includes a foldable mechanism having a knee supporting platform and which is shiftable from a horizontal use position, on the inside of a crutch, to a vertical stowed position. Provision is included for vertical adjustment of the platform whereby a user may easily select either mode of the device when transitioning from a walking to a standing, at-rest position. Alternate knee supporting platform structure is proposed, to accommodate the desires of the user.

7 Claims, 2 Drawing Sheets

KNEE SUPPORTING CRUTCH ATTACHMENT

FIELD OF THE INVENTION

The present invention relates in general to walking aids and in particular to improvements of and attachments to crutches that are used as walking aids.

BACKGROUND OF THE INVENTION

Many developments have been disclosed over the years with regard to walking aids, particularly in relation to crutches. Most of the crutch modifications and improvements have been aimed at providing a crutch which will provide better support for invalids who have lost the use of a leg or a portion of the leg either temporarily or permanently. In these applications, the crutch functions as a replacement or substitute for the injured leg.

Many leg injuries in this active society are to the lower leg only. These types of injuries will quite often leave the upper leg in relatively good shape. The upper leg may still be able to support weight and could be useful were it not for the injured lower leg which must be used to transmit the applied weight to the ground.

DESCRIPTION OF THE RELATED ART

Many efforts have been made in attempt to remedy this problem by modifying the traditional, simple crutch to enable a user of the device to use the upper leg for support while in a standing position. One example of the prior art can be seen in U.S. Pat. No. 4,291,715 issued to W. S. Monte dated Sept. 29, 1981 which discloses a "Foot Support Crutch" that provides a crutch having a support or rest for the lower leg while simultaneously transmitting the applied weight to the ground. The Monte device accomplishes its task very well, however, it is somewhat cumbersome and is not easily stored. U.S. Pat. No. 3,443,569 issued to H. Ernst on May 13, 1969 discloses a folding version of a cane and leg rest, but such mechanism cannot be used for both functions simultaneously. A crutch constructed specifically with a knee support will be found in U.S. Pat. No. 2,678,054 issued May 11, 1954 to Bostelman.

SUMMARY OF THE INVENTION

By the present invention, an improved knee support crutch attachment is provided in which the knee supporting member can be readily and easily opened to an operable position or stored in a flat position against the crutch itself. Moreover, a crutch which is equipped with the present invention may be used in the traditional manner when the knee support is in the stored position, as the attachment is intended to be affixed to a conventional crutch without any significant modification thereof.

The crutch attachment of the present invention comprises two vertical support beams or channels attachable to the vertical shafts of a crutch. The vertical support beams in turn provide attachment points for the collapsible knee support assembly. Attached to each of the vertical support beams are a pair of lower and upper linkage members which lay flat against the crutch while in the stored, non-use position and which form a horizontal, support shelf for the knee or the lower leg when in the opened position, on the inside face of the crutch.

Accordingly, one of the objects of the present invention is to provide an improved crutch attachment which will enable the user to transport and use a crutch in the traditional manner or as a combination crutch and knee support.

A further object of this invention is to provide a knee supporting device which may be easily affixed to the frame of an existing crutch without having to significantly alter the structure of the crutch itself.

A still further object of the present invention is to provide a spring loaded knee supporting crutch attachment which will lock in an open position and will automatically return to the folded position when expressly released from the locked position.

With these and other objects in view which will more readily appear as the nature of the invention is better understood, the invention consists in the novel construction, combination and arrangement of parts hereinafter more fully described, illustrated, and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 2:
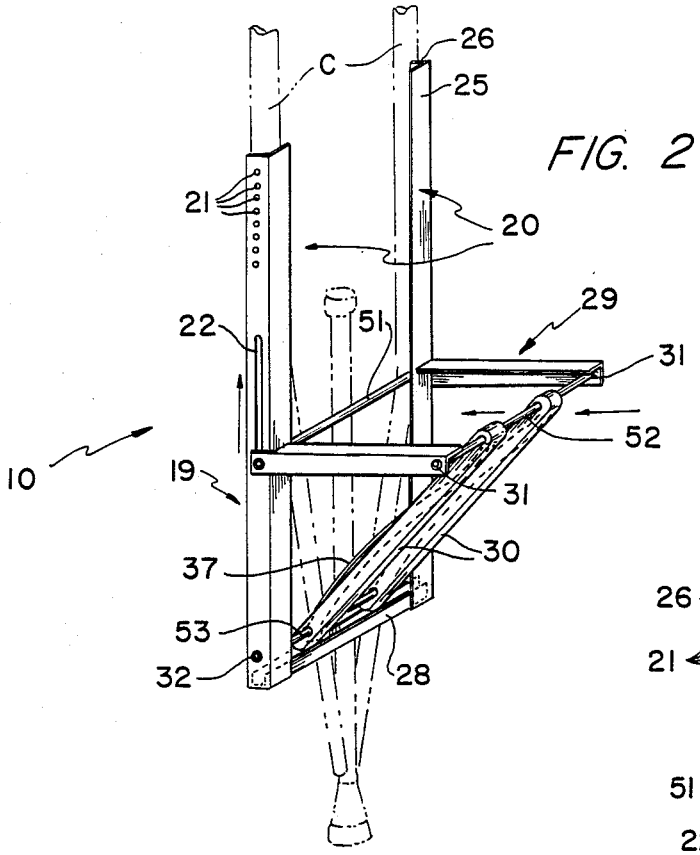
FIG. 2 is a perspective view of the crutch attachment as affixed to a crutch and in the open position, with the knee pad removed for clarity.
Figure 1:
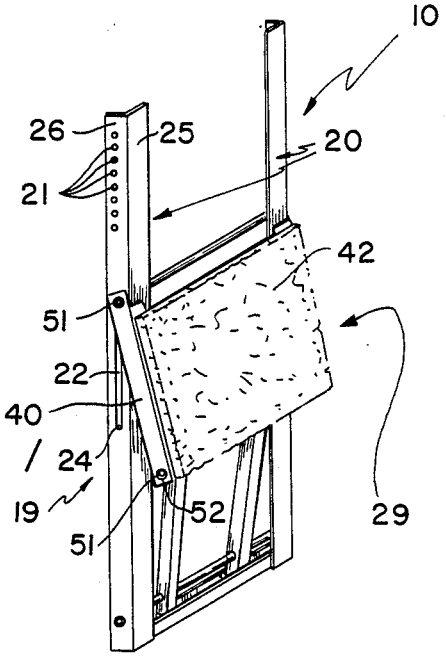
FIG. 1 is a is a side elevation view of the crutch attachment where the knee support assembly is shown in the closed position.
Figure 3:
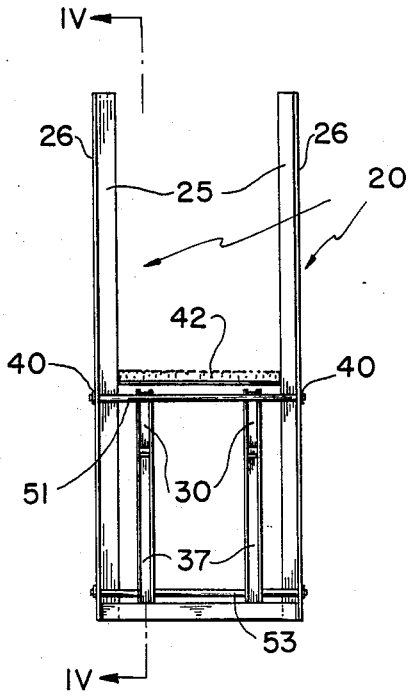
FIG. 3 is a rear elevation view of the crutch attachment.

Referring now to the drawings, particularly FIG. 1, the crutch attachment 10 will be seen to include two basic assemblies, the vertical support assembly 19 and the knee support assembly 29.

The vertical support assembly 19 includes two parallel vertically disposed angle beams or channels 20 joined at the base by a bottom cross brace 28 formed of a substantially "U" shaped member. This vertical support assembly 19 provides the foundation for the mounting and movement of the knee support assembly 29. The vertical channels 20 according to the preferred embodiment of this invention are each constructed from angled aluminum stock. However, the present invention is not to be limited to this material. The beams 20 are oriented so that the one leg 25 of both angle beams 20 project inwardly in a common plane while the other leg 26 of each beam lies in an individual plane rotated ninety degrees from the common plane in the direction of the crutch. Furthermore, the beams 20 are provided with a plurality of holes 21 longitudinally arrayed, to extend downwardly from the upper end and which lie in the side plane 26 of each beam 20. The holes 21 provide a height adjusting means for attaching the device 10 to the frame elements of a crutch C.

Longitudinally disposed along the medial portion of the rearward projecting leg 26 of each beam 20 is a slot 22 of such a size as to enable a slidable and rotatable connection, by means of hinge pin 51, to move within the upper knee support brace 40. Furthermore, the lower end of the slots 22 terminate in a notch 24 which forms a locking area for the sliding mechanism. Each notch 24 projects rearward at an angle of approximately ninety degrees with the slot itself. The opposite end of the upper knee support brace 40 is rotatably joined by hinge pin 52 to the upper end of the lower knee support brace 30 while the lower end of the lower knee support brace 30 is, in turn, rotatably affixed by hinge pin 53 to the bottom end of the vertical support beam 20. The ends of the hinge pin 52 are seated in the upper brace member 40 as at 31 while the ends of the other hinge pin 53 will be seen to be seated in the vertical beams 20 as depicted at 32. To provide for comfortable engagement by the user's knee, the knee support brace members 40 are spanned by a suitably cushioned member 42.

Figure 4:
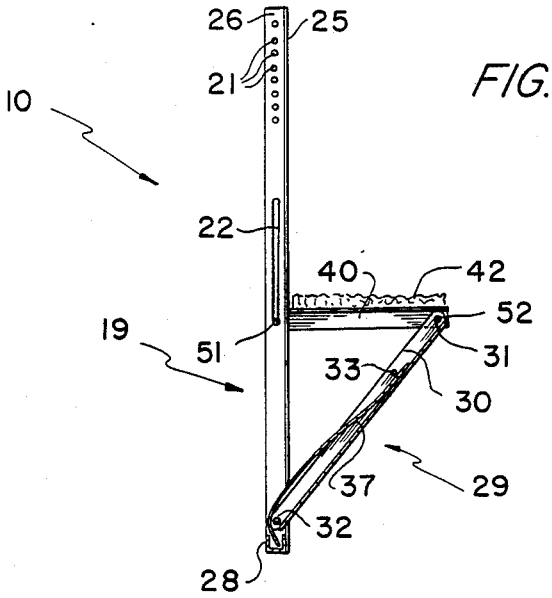
FIG. 4 is a vertical sectional view, taken along the line IV—IV of FIG. 3.

The folding, opening, and locking in the open position of the knee support assembly in an open position is accomplished with the aid of the notch 24 and a pair of leaf springs 37. The lower ends of the leaf springs 37 slide up and down within the interior of the channel cross brace 28 while the upper ends of the leaf springs 37 are affixed to the intermediate portion of the lower knee support braces 30 as will be most readily seen in FIG. 4 at 33. When the knee support assembly 29 is in the folded position, the lower knee support brace and the upper knee support brace are held by the leaf spring in a substantially vertical position against the vertical support assembly. To move the knee support assembly to the locked open position, the hinge pin 52 which joins the bottom end of the upper knee support brace to the upper end of the lower knee support brace, must be moved in a substantially horizontal and forward direction away from the vertical support assembly. This motion will cause the upper end of the lower knee support brace and the lower end of the upper knee support brace to follow an arcuate path away from the vertical support assembly. This arc is defined by a radius equal to the distance along the lower knee support brace from the bottom hinge pin 53 to the middle hinge pin 52, and equates to an axis of rotation located at the bottom hinge pin 53. As the joint defined by the hinge pin 52 moves outward and downward from the stored or folded position, the upper end of the upper knee support brace will move vertically downward, following a path defined by the slot 22 in the vertical support beams 20. Slot 22 of the upper knee support brace, and the lower support brace will work in conjunction with each other to approximate the motion of a sliding crank mechanism. In this respect, the lower knee support brace will function as the crank, the upper knee support brace will function as the connecting rod and the hinge pin 51 will function as the slider with a reciprocating motion along the path defined by the slot 22. Following the sliding crank analogy, and establishing the zero reference angle for the lower knee support brace (crank) at its folded position, the maximum angular displacement of the lower knee support brace (crank) will occur when the hinge pin (slider) reaches the bottom of the slot in the vertical support assembly (slider path) and the upper knee support brace (connecting rod) is substantially perpendicular to the slot in the vertical support assembly (slider path).

The knee support assembly may be locked open only in the fully extended position. To lock the knee support in this position, the device 10 should preferably be held in an upright or vertical attitude. When the knee support assembly is opened to the fully extended position and then released, the spring will force the lower knee support brace to rotate back toward the folded position. This, in turn, will move the upper knee support brace in a lateral direction toward the rear of the device forcing the sliding hinge pin to move into the notch at the bottom of the slot in the vertical support beam. Thus, the device will be locked in the open position. To release the self-locking mechanism and fold the device, the user must simply push the hinge pin 51 forward out of the notch into the main channel of the slot and raise the pin to the point where the spring no longer exerts any force due to its bending.

To install the present invention on an existing crutch, the mounting holes 21 which are located along the top portion of the vertical support beams 20 may be lined up with the existing hand grip attachment holes on the crutch C. The device may then be affixed to the crutch with the aid of a bolt and wing nut. The bolt should be inserted to pass through the holes in the crutch frame and a selected hole 21 in the vertical support beam. A wing nut or the like may then be used to secure the bolt in position.

Figure 5:
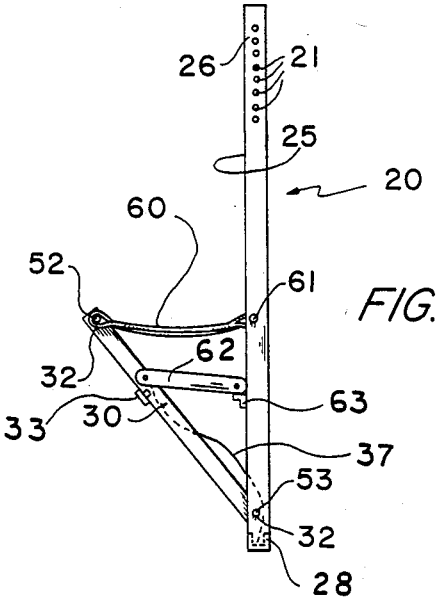
FIG. 5 is a side elevation view of a second embodiment, in the open position.
Figure 6:
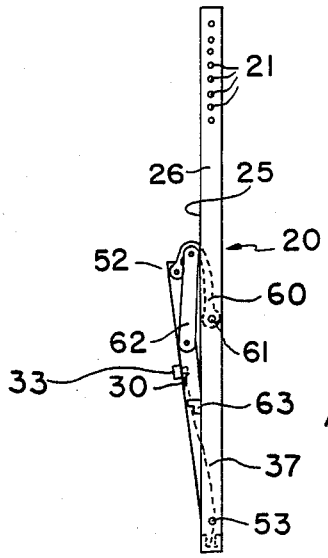
FIG. 6 is a side elevation view of the second embodiment in the closed position.

An alternate embodiment of the present invention makes use of a sling 60 in place of the upper knee support brace 40. Several minor structural changes must be made in order to facilitate the use and installation of the sling. Referring now to FIG. 5, the alternate embodiment is seen to include a sling 60 which is suspended between a fixed rod 61 on the vertical support beam 20 and a hinge 52 at the upper end of the lower knee support brace 30. The upper knee support brace has been shortened and moved to a lower position, the lower end of the alternate support brace 62 is hingedly attached to the medial portion of the lower knee support brace, while the upper end of the alternate support brace is affixed to a hinge pin similar to that of the first embodiment. The mechanism functions in a manner similar to a slider crank mechanism, however the slider portion is not captively held or restricted to a simple linear motion as defined by the slot in the first embodiment. The upper end of the alternate support brace 62 simply slides in a vertical plane along the front of the vertical support beams. The maximum angular displacement of the lower knee support brace is dependent on the length of the sling 60. As the lower end of the alternate support brace 62 is drawn forward away from the vertical support beams, the upper end of the alternate support brace will slide down along the front of the vertical support beam. The alternate support brace 62 will become perpendicular to the vertical support beam 20 just before the fully extended position of the knee support assembly is reached. In the fully extended position of the knee support assembly, the upper end of the alternate support brace will fall past the point where the brace is perpendicular to the vertical support beam and will fall to rest on a brace stop 63 which projects horizontally forward from the vertical support beam.

I claim:

1. A crutch attachment for supporting a knee comprising:

a vertical support assembly having a top end and a bottom end adapted for attachment to an existing crutch structure; and a spring loaded knee support assembly retractably affixed to said vertical support assembly;

said spring loaded knee support assembly comprises an upper knee support brace having a first end and a second end, wherein said first end is rotatably and slidably affixed to said vertical support assembly, and said second end is rotatably affixed to a lower knee support brace;

said lower knee support brace having a first end and a second end, wherein said lower support brace first end is rotatably affixed to said second end of said upper knee support brace, said lower support brace end rotatably affixed above the bottom end of the vertical support assembly; and a kneepad affixed adjacent to said second end of the upper knee support brace.

2. A crutch attachment for supporting a knee according to claim 1 wherein:

said vertical support assembly attachable to an existing crutch structure includes locking means to retain said knee support assembly in an open position.

3. A crutch attachment for supporting a knee according to claim 1 wherein:

said knee support assembly includes spring means, said spring means retaining said knee support assembly in a substantially vertical position against said vertical support structure.

4. A crutch attachment for supporting a knee comprising:

a vertical support assembly having a top end and a bottom end for attachment to an existing crutch structure, said crutch having a vertical length, said vertical support assembly adapted for attachment intermediate said vertical length; and a spring loaded knee support assembly retractably affixed to said vertical support assembly;

said spring loaded knee support assembly comprises an upper knee support brace having a first end and a second end, wherein said first end is rotatably and slidably disposed relative to said vertical support assembly, and said second end is rotatably affixed to a lower knee support brace;

said lower knee support brace having a first end and a second end, wherein said lower support brace second end is rotatably affixed above the bottom end of the vertical support assembly; and knee placement means disposed above said upper knee support brace.

5. A crutch attachment for supporting a knee according to claim 4 wherein:

said knee placement means comprises a sling having first and second ends, said sling first end being attached to said lower knee support first end and said sling second end being attached to said vertical support assembly.

6. A crutch attachment for supporting a knee according to claim 4 wherein:

said upper knee support brace first end is slidably and rotatably mounted abuttingly adjacent said vertical support assembly, and a stop is mounted to said support assembly below said upper knee support brace first end.

7. A crutch attachment for supporting a knee according to claim 4:

said knee support assembly includes spring means, said spring means retaining said knee support assembly in a substantially vertical position against said vertical support structure.

* * * * *